US007000296B1

(12) United States Patent
Berg et al.

(10) Patent No.: US 7,000,296 B1
(45) Date of Patent: Feb. 21, 2006

(54) METHOD AND AUXILIARY DEVICE FOR LEASING THREADS INTO GUIDE ELEMENTS OF A HANDLING DEVICE FOR HANDLING THREADS AND A HANDLING DEVICE OF THIS TYPE

(75) Inventors: Hans Berg, Schopfheim (DE); Heinrich Johann Mensing, Talstrasse 69, D-41516 Grevenbroich (DE); Wolfgang Lange, Schopfheim (DE)

(73) Assignee: Heinrich Johann Mensing, Gescher (DE)

( * ) Notice: Subject to any disclaimer, the term of this patent is extended or adjusted under 35 U.S.C. 154(b) by 620 days.

(21) Appl. No.: 09/763,635

(22) PCT Filed: Jun. 15, 2000

(86) PCT No.: PCT/EP00/05532

§ 371 (c)(1),
(2), (4) Date: Apr. 12, 2002

(87) PCT Pub. No.: WO01/06049

PCT Pub. Date: Jan. 25, 2001

(30) Foreign Application Priority Data

Jul. 16, 1999 (EP) ..... 99810641

(51) Int. Cl.
*D02H 13/16* (2006.01)
*B65H 57/16* (2006.01)

(52) U.S. Cl. ..... 28/199; 29/212; 29/190

(58) Field of Classification Search ..... 28/199, 28/198, 212, 213, 172.1, 178, 181, 190, 193, 28/194, 195, 196, 202, 203.1, 204, 207.1, 28/208; 242/131, 131.1, 157 R, 157.1
See application file for complete search history.

(56) References Cited

U.S. PATENT DOCUMENTS

| | | | | | |
|---|---|---|---|---|---|
| 1,346,498 | A | * | 7/1920 | Lea | 28/198 |
| 1,357,346 | A | * | 11/1920 | Player | 28/203.1 |
| 2,152,430 | A | * | 3/1939 | Hassold | 28/199 |
| 3,317,979 | A | * | 5/1967 | Furst | 28/199 |
| 3,534,921 | A | * | 10/1970 | Koslowski | 242/131 |
| 3,678,548 | A | * | 7/1972 | Largeron et al. | 28/199 |
| 3,744,110 | A | * | 7/1973 | Baba et al. | 28/181 |
| RE28,347 | E | * | 2/1975 | Abilock et al. | 28/187 |
| 4,009,512 | A | * | 3/1977 | Baba | 28/179 |
| 4,528,732 | A | * | 7/1985 | Lichtschlag | 28/199 |
| 4,894,892 | A | * | 1/1990 | Duda | 28/172.1 |
| 5,027,485 | A | * | 7/1991 | Hager et al. | 28/191 |
| 6,076,243 | A | * | 6/2000 | Sartain et al. | 28/199 |
| 6,195,856 | B1 | * | 3/2001 | Kremer | 28/185 |

FOREIGN PATENT DOCUMENTS

| | | | |
|---|---|---|---|
| DE | 1535181 | * | 3/1970 |
| DE | 3029987 | * | 2/1982 |

* cited by examiner

*Primary Examiner*—Amy B. Vanatta
(74) *Attorney, Agent, or Firm*—Shoemaker and Mattare

(57) ABSTRACT

In order to lease threads (F), in particular warp threads into guide elements (2) of a handling device (1), such as combs or reeds, the threads (F) are first leased in sequence into a leasing comb (11) and are fixed thereto. The threads (F) are subsequently guided through the device (1) by means of the leasing comb (11). During this process, the threads (F) are taken up by the guide elements (2).

9 Claims, 9 Drawing Sheets

METHOD AND AUXILIARY DEVICE FOR LEASING THREADS INTO GUIDE ELEMENTS OF A HANDLING DEVICE FOR HANDLING THREADS AND A HANDLING DEVICE OF THIS TYPE

BACKGROUND OF THE INVENTION

The invention relates to a method and an auxiliary device for teasing treads into guide elements of a treatment device for treating threads, as well as to such a treatment device.

In preparation for the weaving mill individual threads in warps are led through treatment devices which for example may serve for treating the threads, but also for sectional warping or beaming. A typical treatment of warp threads is the sizing.

Such treatment devices are usually provided with guide elements in which the threads are guided. On sizing, for example up to 16,000 threads may be treated simultaneously. With this e.g. up to 16 threads are guided into 1,000 interstices lying next to one another of such a guide element. Guide elements are for example combs or reeds.

If (for example with the sizing procedure) the warp beams with the threads to be treated are empty, these must be replaced by complete warp beams. This means that the thread of the new warp beams must be individually guided through the guide elements. This procedure is also described as leasing. The leasing of for example up to 16,000 warp threads into several guide elements arranged next to one another is time-consuming and may take up to 6 hours. In this time the installation is out of action and no productive operation of the device is possible.

SUMMARY OF THE INVENTION

It is therefore an object of the present invention to avoid the disadvantages of that which is known, in particular to provide a method and an auxiliary device for leasing threads, which permit a rapid and secure leasing of the threads into one or several guide elements of a device for treating the treads. The method and the auxiliary device should furthermore ensure that the threads in an ordered manner may be leased into the guide elements, tat in particular no crossovers take place. A further object of the invention lies in providing a treatment device with guide elements which permits a simple and rapid leasing of tread into guide elements. The method and the auxiliary device according to the invention should furthermore be able in a simple manner to be carried out and manufacturable respectively and able to be used with existing treatment devices without great modifications.

According to the invention these objects are achieved with a method, with an auxiliary device and with a device, as described below.

The method serves for leasing treads into guide elements of a treatment device for treating the threads. In particular the method for leasing warp treads may be applied for example in a sizing installation. The guide elements are for example combs or reeds of such a sizing installation.

For leasing the treads these are leased into at least one leasing comb and fastened on this. Subsequently the threads with the leasing combs are pulled through the treatment device. With this the threads are taken up by the guide elements.

The leasing combs form an auxiliary device for leasing the threads. It is sufficient to lease the threads in the leasing combs once and to fasten these on the leasing combs. With this the position of the threads is exactly defined. If the leasing combs are pulled through the treatment device the individual threads without great effort on account of their ordered position may be directly introduced into the guide elements.

In a preferred embodiment example of the method the leasing combs in steps are led through the treatment device. The movement of the leasing combs is in each case interrupted as soon as the leasing combs have passed a guide element. The leasing combs are positioned in relation to the guide element, before the threads are taken up by the guide element. The threads are thus pulled by the leasing combs over the guide element. Thereafter the movement of the threads is interrupted and the threads may be introduced into the guide elements.

In a further preferred embodiment example the guide elements before the leasing are removed from the path formed for the threads in the treatment device. Typically the guide elements in the treatment device may be lowered or raised. After passing the leasing combs the guide elements are again moved back into the path for the threads. With this the threads are taken up by the guide elements.

The method may be advantageously applied with leasing combs which comprises leasing interstices for receiving the threads. The arrangement of the leasing interstices corresponds to the arrangement of interstices in the guide elements. The leasing combs may furthermore be provided with aligning projections which extend away from the leasing interstices. With the method according to the invention the leasing combs are aligned with regard to the guide elements in that the aligning projections are brought into engagement with the interstices of the guide elements. The aligning projections ensure that the leasing interstices of the leasing combs are in alignment with the interstices of the guide elements. The threads may thus be securely and simply transferred.

The alignment may be effected particularly simply when with the moving back of the guide elements their interstices are pushed over the aligning projections.

The leasing combs may be particularly simply moved through the treatment device in that the combs are fastened on the residual treads from a preceding treatment procedure and is pulled with the residual treads trough the device.

The auxiliary device according to the invention, for leasing threads, for example warp threads, into guide elements of a treatment device for treating the threads is particularly advantageous for carrying out the mentioned method. The auxiliary device is designed as leasing combs which comprises an arrangement for the ordered fastening of the threads.

The leasing combs are preferably provided with a multitude of leasing interstices arranged next to one another. The leasing interstices serve for receiving the threads. The arrangement of the leasing interstices is with this matched to the arrangement of the interstices in the guide elements. With this the transfer of the threads from the leasing interstices of the leasing combs into the interstices of the guide elements is possible in an ordered manner.

The leasing combs are furthermore advantageously provided with aligning elements for aligning the leasing combs with respect to the guide elements. With this it is ensured that not only is the relative position of the threads to one another defined but also their position in relation to the guide elements.

The aligning elements are typically designed as aligning projections. The aligning projections extend preferably from the leasing interstices and may be brought into engagement with the interstices in the guide elements. With the leasing combs aligned with respect to the guide elements the aligning projections, the leasing interstices in the leasing combs and the interstices are in alignment with one another.

Particularly advantageously each leasing combs is designed as a stack of platelets. With this first platelets are arranged at a distance to one another for forming the leasing interstices. Second platelets serve as distancers and are arranged between the first platelets. The second platelets furthermore advantageously form a rest surface for the threads in the leasing interstices. The second platelets may furthermore be provided with projections which serve as aligning elements. With projections designed in such a manner it is automatically achieved that the projections are in alignment with the leasing interstices. Because the thickness of the distancers, that is to say of the second platelets, corresponds to the width of the leasing interstices and thus is adapted to the width of the interstices in the guide elements, the second platelets with their projections may be particularly simply introduced into the interstices of the guide elements. For the simplified introduction the projections may furthermore comprise tapering lugs.

The leasing combs may furthermore be provided with holding elements which serve the temporary receiving and holding of the leasing combs in receiving devices allocated to the guide elements.

Alternatively it is also conceivable to design the leasing combs as one piece and to incorporate the leasing interstices by way of suitable material treatment for example milling or eroding. The aligning projections may with this be formed by disklets inserted into the leasing interstices. The disklets may be grouped together with one another into a comb.

Instead of removing the guide elements out of the path for the threads it is also conceivable to not move the guide organs and instead of this to move and thus align the leasing combs with respect to the guide elements for transferring the threads.

The treatment device according to the invention for treating threads is characterized in that to the treatment device there is allocated at least one leasing comb. The leasing combs may in particular be designed in the described way and manner. On the leasing combs the threads are fastenable in an ordered manner. The threads may be taken up by guide elements in the treatment device from the leasing combs.

Advantageously to the guide elements there is allocated at least one receiving device for the temporary holding of the leasing combs. As soon as the leasing combs have passed the guide elements, the movement of the leasing cam is interrupted and this may by way of holding elements be held exatcly positioned in the receiving device.

This arrangement is particularly advantageous when the guide elements are designed movable out of the path for the treads formed in the treatment device. Typically the guide elements are lowerable or raisable.

This arrangement has the advantage that the leasing combs may be pulled through the treatment device until it meets a receiving device. The guide elements moved away from the path for the threads do not disturb the movement of the leasing combs. As soon as the leasing combs are positioned in the receiving device the guide elements are again moved into the path for the threads. With this the threads are automatically correctly introduced into the guide elements.

The device according to the invention is particularly advantageous when it comprises several mounts for receiving the threads to be treated, in particular several mounts for warp beams. The threads from at least one mount may with this be leased into a leasing comb while the threads of another mount may be led through the treatment device and at the same time be treated. The standstill times of such a treatment device are thus reduced,

BRIEF DESCRIPTION OF THE DRAWINGS

The invention is hereinafter described in more detail by way of the drawings, wherein.

DESCRIPTION OF THE PREFERRED EMBODIMENTS

Figure 1:
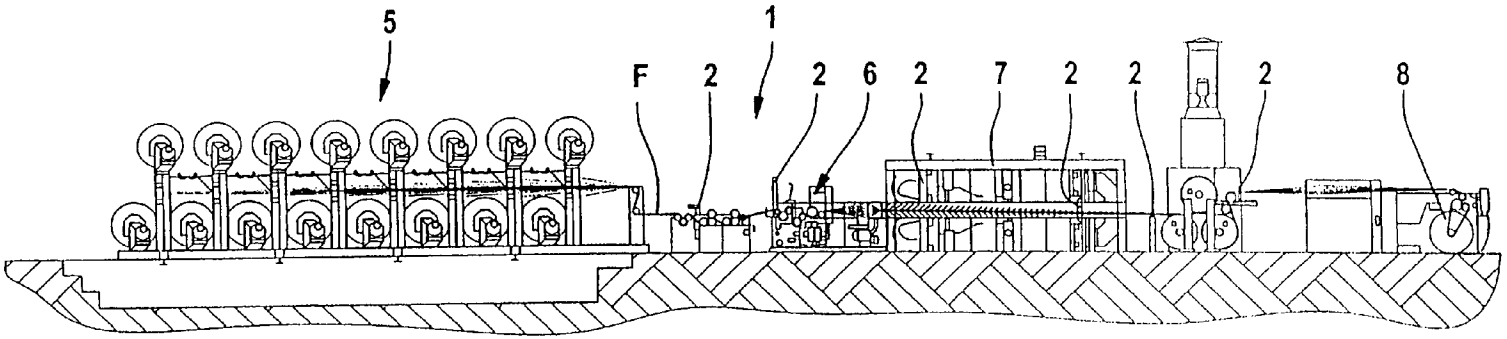
FIG. 1 is a schematic representation of a device according to the invention in a lateral view.

In FIG. 1 there is schematically shown a treatment device 1, with which the method according to the invention and the auxiliary device according to the invention may be applied. The treatment device 1 serves for sizing threads F. The threads are held on warp beams in a mount 5 and from these led to the device 1. The device 1 comprises a sizing device 6, a dryer 7 connecting thereto and a beaming machine 8 for winding the treated threads F. The threads F are continuously conveyed through the treatment device 1, that is to say from the mount 5 to the beaming machine 8.

Figure 2:
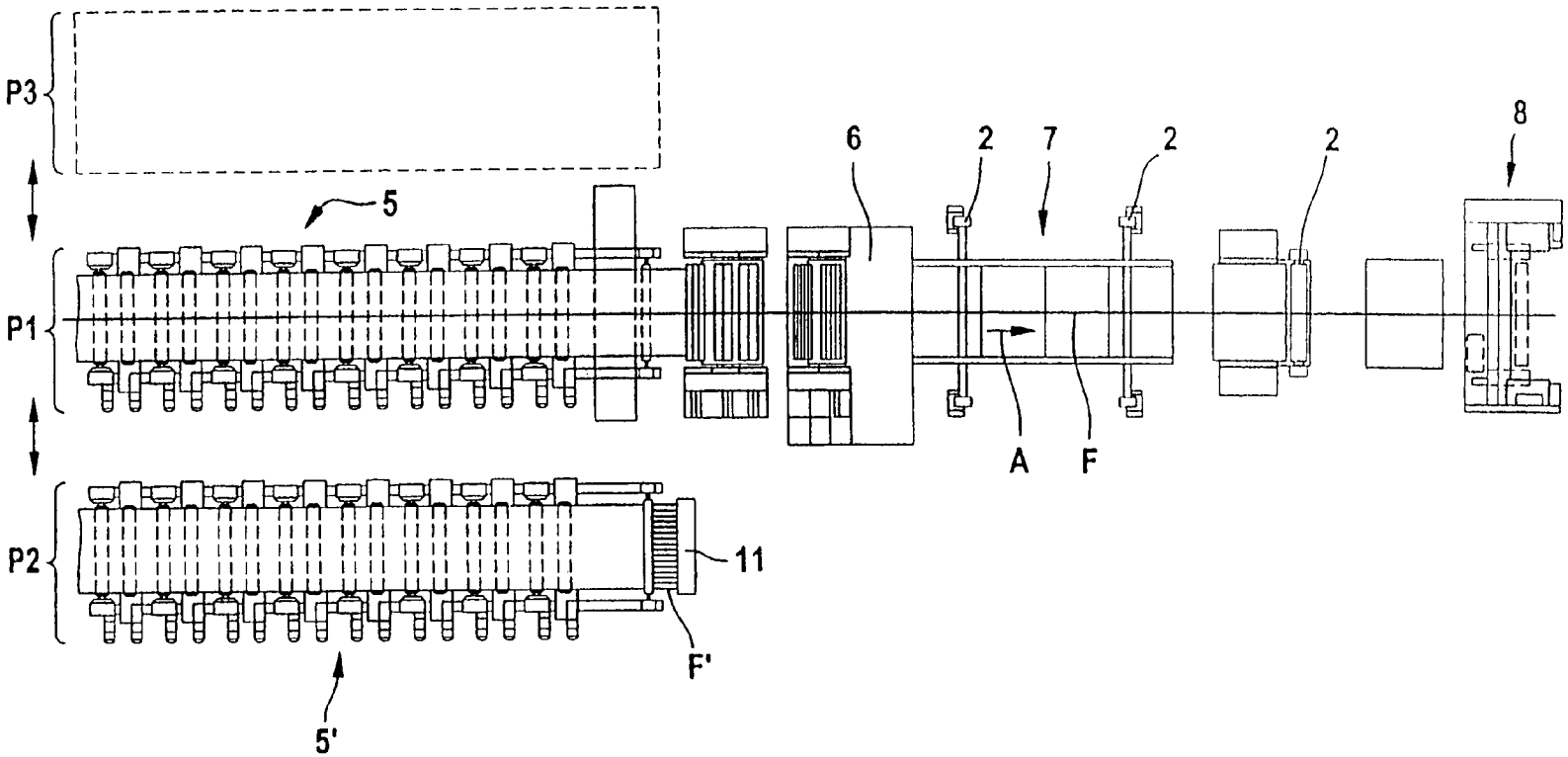
FIG. 2 is a plan view of the device according to FIG. 1.

FIG. 2 shows a plan view of the device 1 according to FIG. 1. The threads F are led from the mount 5 through the sizing device 6, the dryer 7 and via deflection arrangements not described in more detail to the beaming machine 8. With this simultaneously a thread warp of about 1,000 times 16 threads are treated. On each of the warp beams held in the mount 5 there are located 1,000 threads.

For leading the threads F in the device 1 this is provided with various guide elements 2. The guide elements 2 are designed as combs or reeds through which the threads are led.

Next to the mount 5 there is arranged a further auxiliary mount 5' which likewise contains 16 warp beams each @ 1,000 threads.

While the mount 5 is located in a position P1, the threads F are treated. Simultaneously it is possible to lease the threads of the mount 5 in the position P2 into a schematically shown leasing comb 11.

Thanks to the additional mount 5' and the leasing combs 11 it is possible in the position P2 to fasten the threads F' on the leasing combs 11 in an ordered manner, while the threads F of the mount 5 located in the position P1 are still treated. As soon as the warp beams on the mount 5 are empty the mount 5 is displaced into the position P3 and replaced by the mount 5'. The mount 5' is with this displaced from the position P2 to P1. The threads of the now full warp beam may simply be leased into the guide elements 2 of the treatment device 1 in that they by way of the leasing combs 11 are pulled in the direction A through the treatment device 1. At each guide element 2 the leasing combs 11 are aligned with respect to the guide element 2 and the threads F connected to the leasing combs 11 are transferred to the guide element 2, which means leased into this. In this context, leasing is to be understood as the leading-through of the threads F through the openings or interstices of the guide elements 2.

Figure 3:
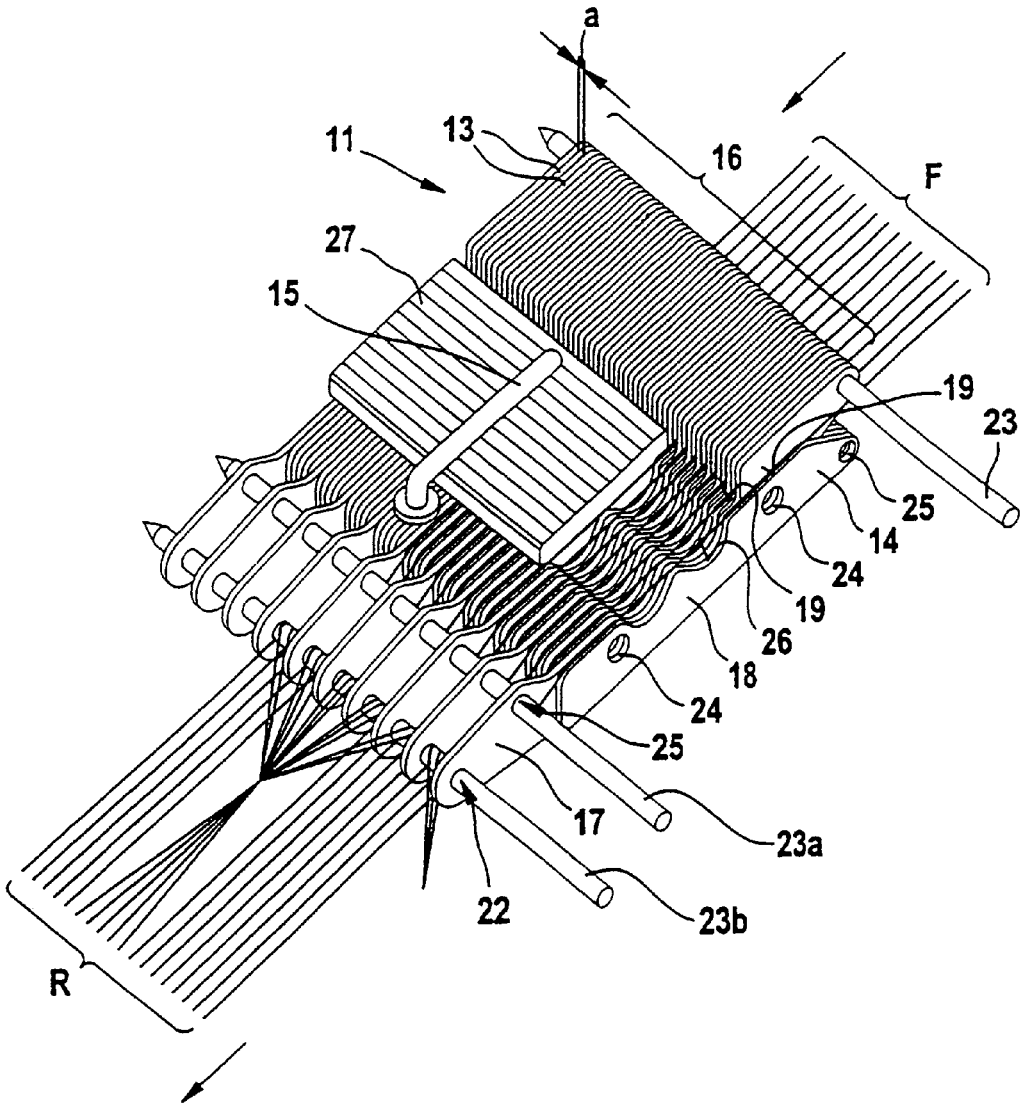
FIG. 3 is a perspective representation of an auxiliary device according to the invention.

FIG. 3 shows in a perspective representation a leasing comb 11. The leasing comb 11 consists of a stack 16 of thin platelets. First platelets 17 are arranged next to one another at a distance a to one another. Between the first platelets 17 there are arranged second platelets 18 which define the distance a. The distance a forms leasing interstices between the first platelets 17.

The platelets 17, 18 are provided with bores 24 through which a holding-together device, for example a pin or clamping device may be led in order to hold the stack 16 together.

The leasing comb 11 is furthermore provided with a clamping device 15 which may be pressed against a surface formed together by the first platelets 17 and the second platelets 18.

Before threads F of a new warp beam are led through the device 1 they are leased into the leasing combs 11. For this the threads F are led through the leasing interstices 13 of the leasing combs 11. For representational reasons there is shown only a small number of treads. Usually in each leasing interstice 13 there are leased in each case up to 16 threads. The threads F run over the rest surface 19 formed by the surface of the second platelets 18 and over the surface 26 formed together by the first platelets 17 and the second platelets 19. By pressing the threads F with the clamping device 15 against the surface 26 the threads F are fixed on the leasing combs 11. The fixing is with this ordered since the threads F are led through the leasing interstices 13.

The leasing combs 11 are furthermore provided with bores 25 through which pins 23, 23*a* may be inserted. The pins 23 prevent the threads F themselves from coming out of the leasing interstices 13. The pin 23*a* permits the fastening of the ends of the threads F.

The leasing combs 11 have a further bore 22 through which a further pin 23*b* is insertable on which residual threads R are fastenable. The residual threads R may be threads from a preceding treatment procedure. The leasing comb 11 are subsequently pulled through the device 1 with the residual thread R.

Figure 4A:
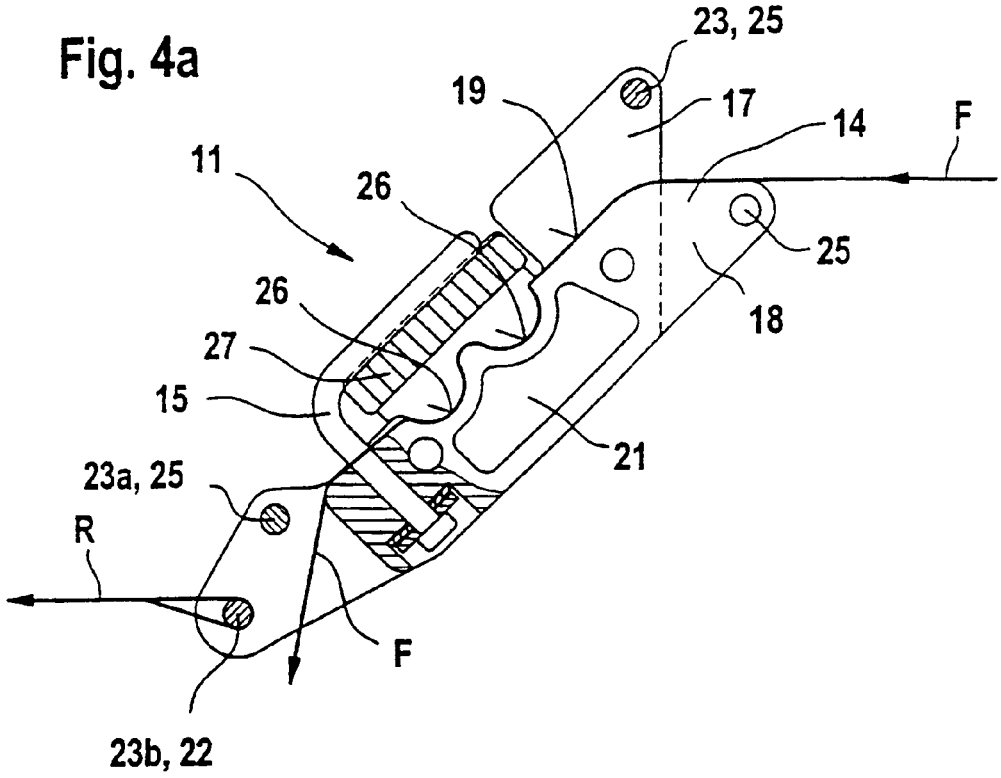
FIGS. 4*a* and 4*b* are lateral views of two embodiment examples in an auxiliary device.
Figure 4B:
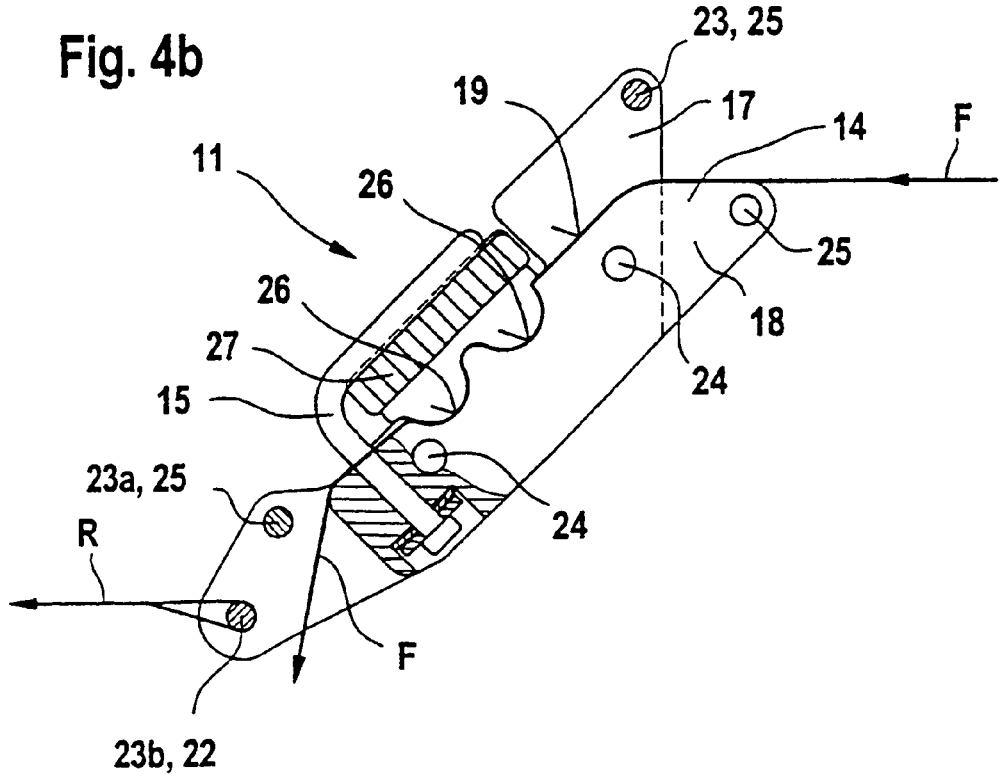

FIGS. 4*a* and 4*b* show various embodiment examples of a leasing comb 11 in a lateral view.

The leasing combs 11 are in the manner shown in FIG. 3 constructed of a stack of platelets 17, 18. According to the embodiment example in FIG. 4*a* the platelets comprise openings which form a hollow space 21. The platelets 17, 18 may be held together in that the hollow space is bushed. In the embodiment example according to FIG. 4*b* suitable fastening means are introduced into the bores 24 in order to hold together the platelets 17, 18. Otherwise the leasing combs of FIG. 4*a* and FIG. 4*b* do not differ.

The threads F via an aligning projection 14 and via a rest surface 19 of the second platelets 18 are led through the leasing interstices 13 between the first platelets 17. The aligning projections 14 serve for aligning the leasing combs with respect to the guide elements 2 (see FIGS. 5, 6 and 8).

The clamping device 15 is shown schematically as a pivotable lever which presses a clamping element 27 against the surface 26. Of course other fastening possibilities such as knotting or winding round are also conceivable.

In the region of the surface 26 the upper edges of the first platelets 17 and of the second platelets 18 are aligned to one another so that a closed surface is formed. Outside the surface 26 the platelets 17 project beyond the rest surface 19 of the platelets 18 so that between the platelets 17 there are formed the leasing interstices 13.

Figure 5:
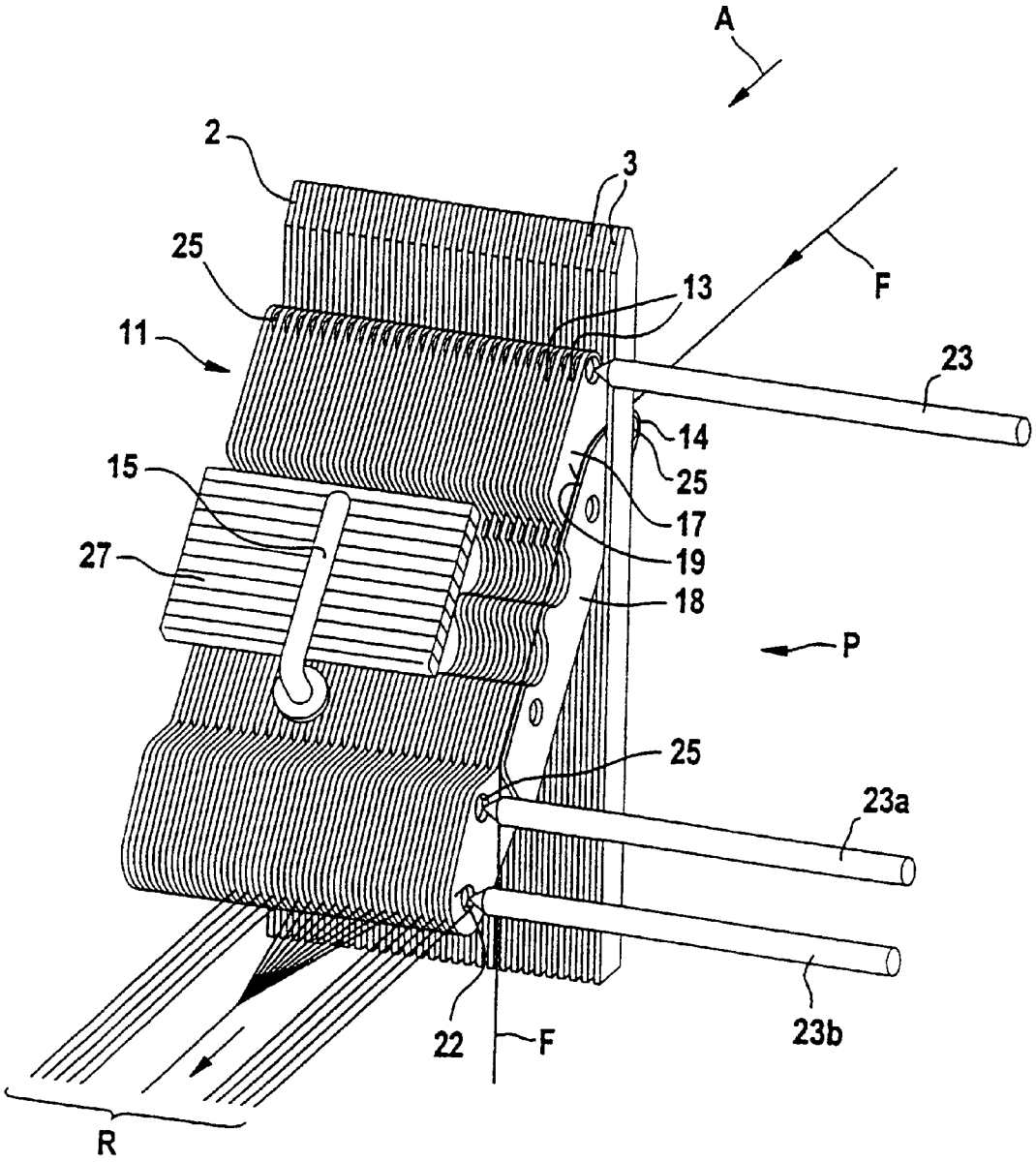
FIG. 5 is a perspective representation of the take-up of the threads, in a lateral view.

For leasing the threads F through the treatment device I as shown in the FIGS. 3, 4*a* or 4*b* firstly the thread warp is leased into the leasing combs. Subsequently the leasing combs 11 with the residual threads R are pulled through the treatment device 1. As soon as the leasing combs 11 have passed a guide element 2 the movement of the leasing combs 11 is temporarily interrupted. FIG. 5 shows the leasing combs 11 in such a rest position P. The rest position P with respect to the movement direction A lies after the guide element 2. The guide element 2 consists of a multitude of lamellae arranged next to one another, between which interstices 3 are formed. For leasing the threads F into the interstices 3 the leasing combs 11 is aligned with respect to the guide elements 2. For this the aligning projections 14 are brought into engagement with the interstices 3 of the guide elements. With this the guide elements 2, the leasing interstices 13 of the leasing combs 11 and the second platelets 18 are aligned to one another. Likewise the first platelets 17 are in alignment with the lamellae of the guide element 2. The threads F held between the first platelets 17 in the leasing interstices 13 are thus automatically leased into the interstices 3. As soon as the engagement between the aligning projections and the interstices 3, which is shown in FIG. 5, has be created, the threads F are leased and the leasing combs 11 may be moved in direction A further to a subsequent guide element 2. At the subsequent guide element 2 again the procedure shown in FIG. 5 is repeated.

Figure 6A:
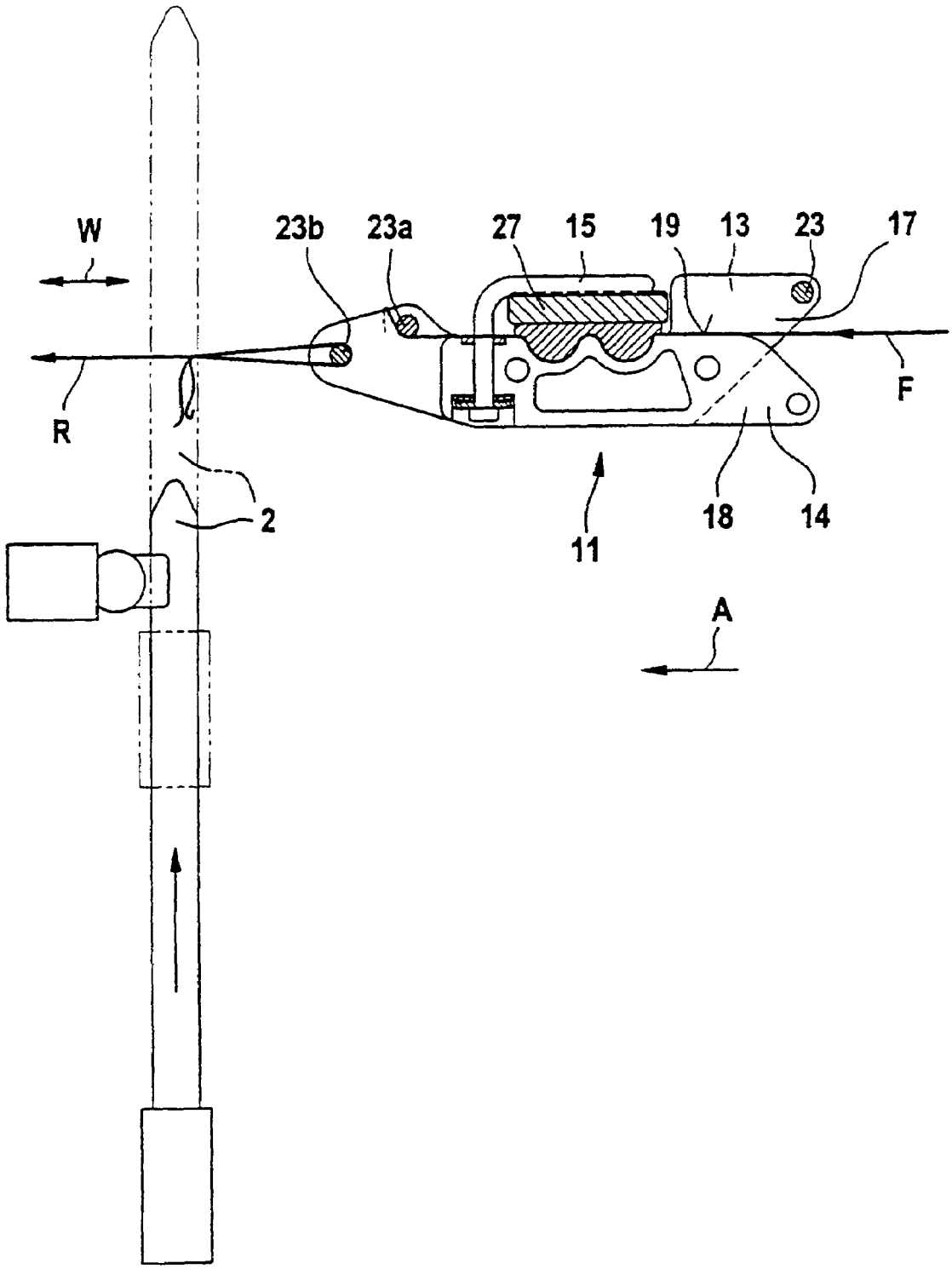
FIGS. 6*a*–6*c* are schematic representations of the laying down of threads in a lateral view.
Figure 6B:
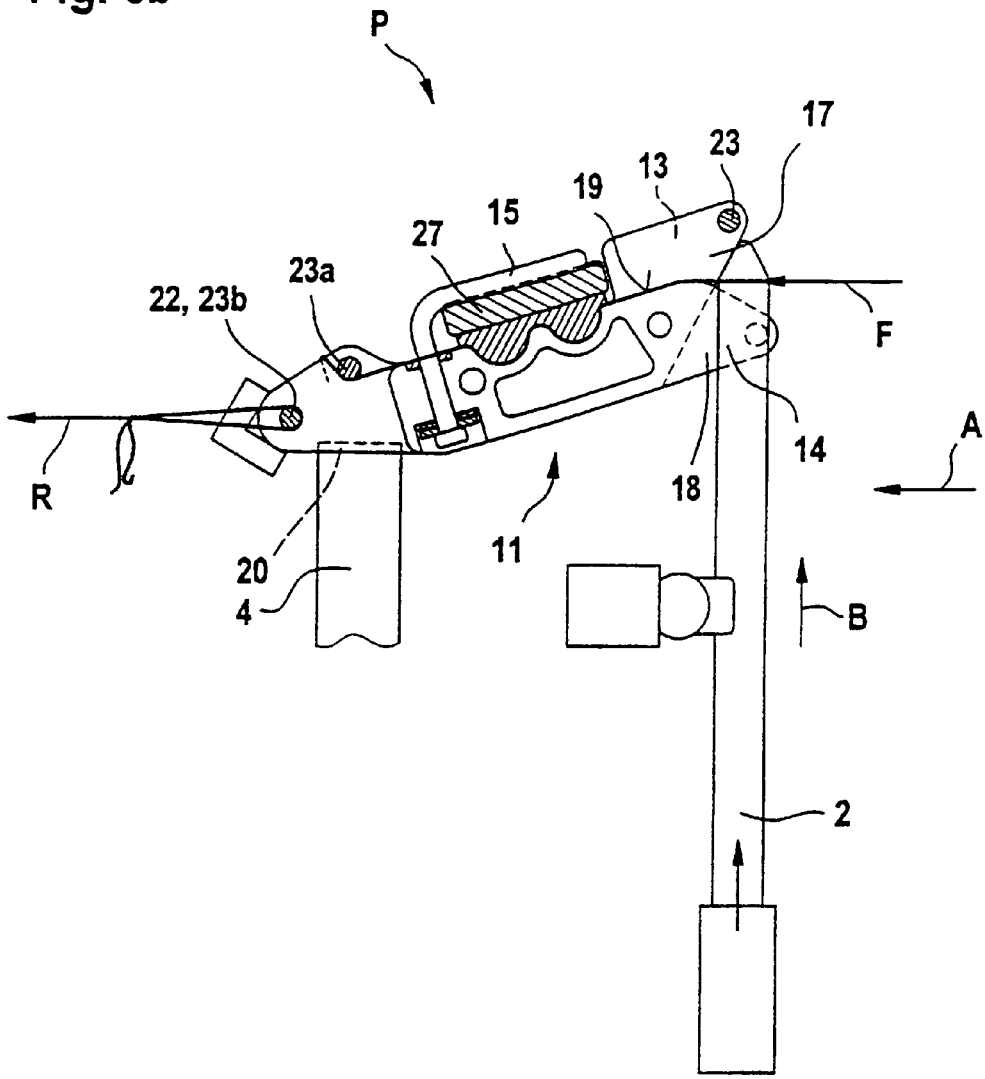
Figure 6C:
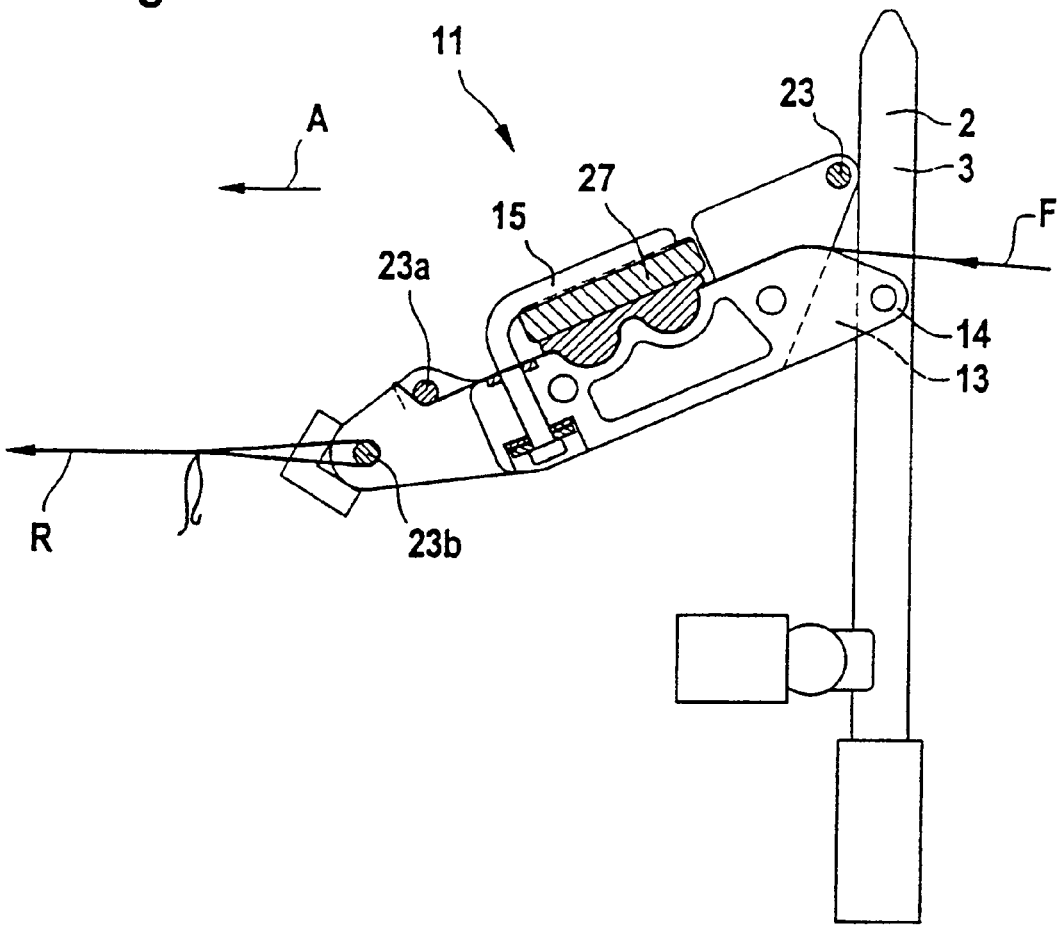

In FIGS. 6*a* to 6*c* the transfer procedure is shown schematically in a lateral view.

Usually the guide elements 2 are located in the position shown dashed in FIG. 6*a*. The guide elements 2 lie with this in the path W formed for the threads F. According to FIG. 6*a* the guide elements 2 are removed from the path W for the threads F.

The threads F are pulled with the leasing combs 11 in the direction A through the device 1. The guide elements 2 are designed lowerable and before the leasing procedure are lowered, Alternatively it would also be conceivable to raise the guide elements 2 or to leave the guide elements 2 stationary and to lower or raise the leasing combs 11 for leasing the threads F into the guide elements 2.

The leasing combs 11 are pulled with the residual threads R.

As soon as the leasing combs 11 have passed the guide elements 2 in the direction A (see FIG. 6*b*) the movement of the leasing combs 11 is temporarily interrupted. For this the leasing combs 11 are provided with holding elements 20 which may be brought into engagement with a receiving device 4 allocated to the guide element 2. The receiving device 4 permits a positioned holding of the leasing combs 11. As soon as the leasing combs 11 have reached the position P the guide elements 2 are guided over the aligning projections 14 of the leasing combs 11. In this manner an exact alignment of the interstices 3 with respect to the leasing interstices 13 is guaranteed. If the guide elements 2 are completely raised (see FIG. 6*c*) the threads F run in the interstices 3 of the guide elements 2 and are thus leased into the guide elements.

The leasing comb 11 extends over the whole width of the device 1. Typically the width is 1.2 to 2 m. It is also conceivable to use individual, smaller leasing combs. The leasing comb 11 is for example designed for receiving 1,000 groups @ 16 threads. For this there are provided 1,000 second platelets 18 which alternately are arranged with 1,001 first platelets 17. The first and second platelets 17, 18 consist typically of steel and are for example manufactured by laser cutting or punched out. The thickness d of the second platelets 18 corresponds to the distance a between the first platelets 17 and simultaneously at least the thickness D between 2 individual elements of the guide elements 2, that is to say the width D of the interstices 3 (see FIG. 8). The thickness of the first platelets 17 corresponds typically to the thickness of the lamellae of the guide elements.

Figure 8:
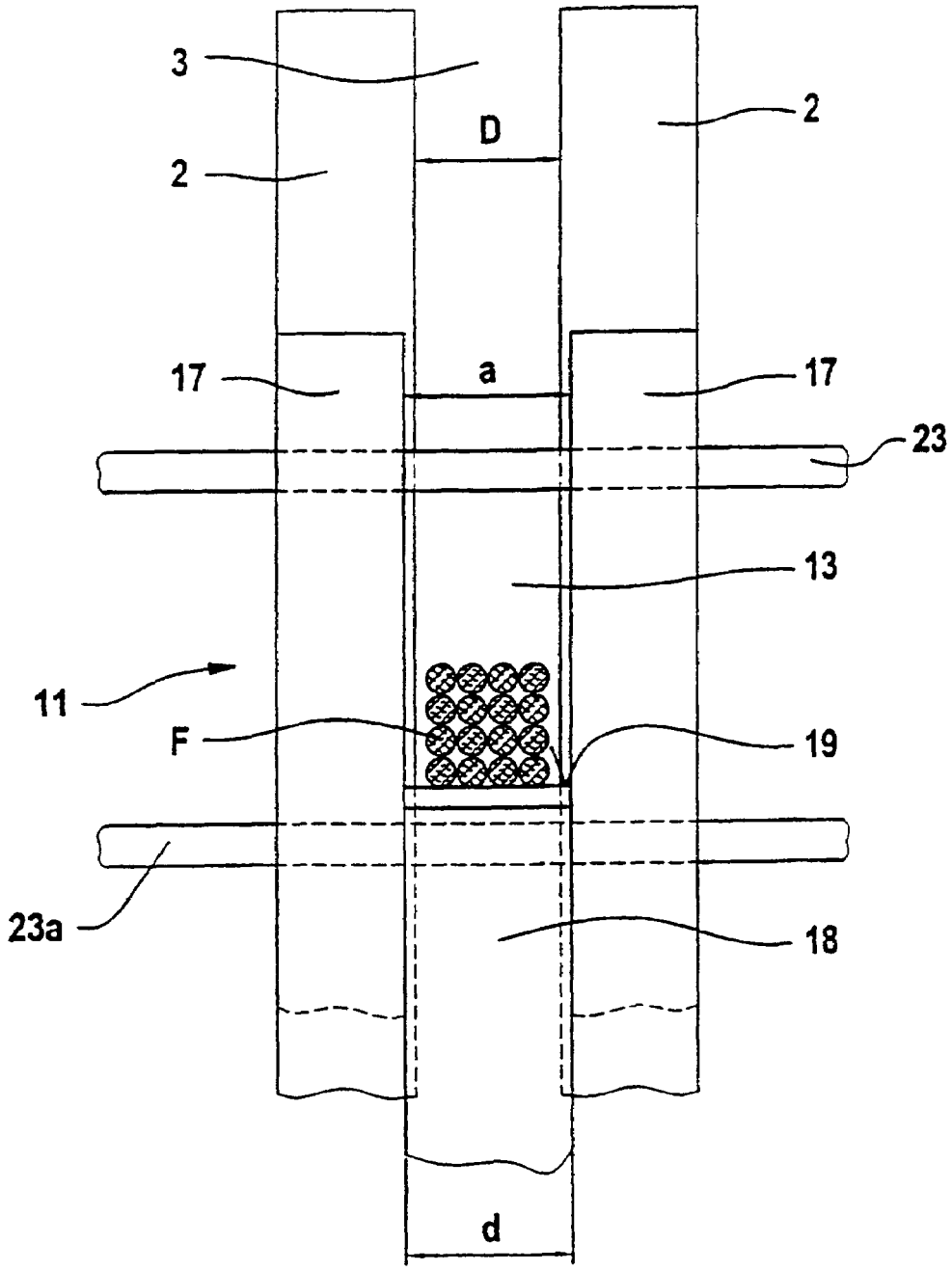

FIG. 8 shows in an enlarged representation how the threads F are transferred into the interstices 3 of the guide elements 2. The threads F lie on the rest surface 19 which is formed by the second platelets 18. The leasing interstices 13, the second platelets 18 and the interstices 13 of the guide elements are in alignment with one another, This is ensured by the aligning projections 14 which engage into the interstices 3. Thus it is guaranteed that the threads F are securely leased into the interstices 3.

The pin 23 prevents the threads F from jumping up out of the leasing interstices 13.

Figure 7:
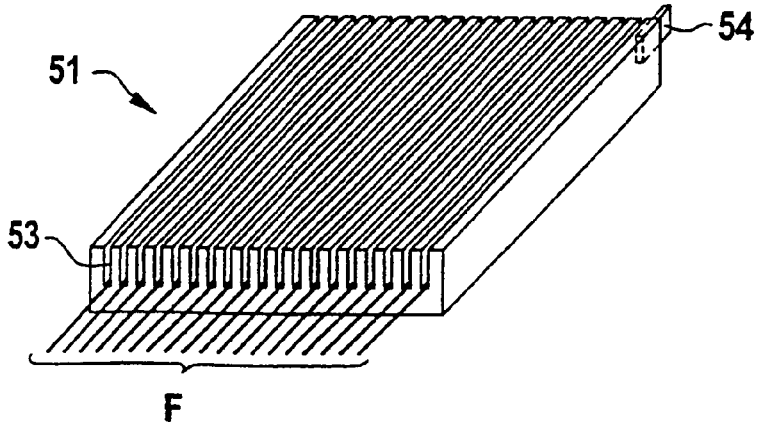
FIG. 7 is a perspective representation of an alternative embodiment example of an auxiliary device and FIG. 8 is a plan view of a cut-out of an auxiliary device on transferring the threads.

In FIG. 7 there is schematically shown an alternative embodiment example of a leasing comb 51. The leasing comb 51 is designed as one piece. Into the leasing comb 51 there are milled leasing interstices 53 through which the threads F may be guided. On the one side of the leasing comb 51 into the leasing interstices 53 there are inserted projections 54 which serve for aligning the leasing comb 51 with respect to the guide elements.

Instead of individual aligning projections 14, 54 it is also conceivable to align the leasing comb 11, 51 with e.g. laterally arranged separate aligning elements on the guide elements 2. These aligning elements may for example be arranged laterally on the guide elements and on the leasing comb. It is however also conceivable to move the leasing comb 11, 51 on guides through the device 1. Such guides may likewise be provided in the device. Such guides permit a particularly stable movement of the leasing comb 11, 51.

What is claimed is:

1. A method for leasing threads into guide elements of a treatment device for treating the threads, comprising the steps of leasing the threads into at least one leasing comb, fastening the threads onto said comb, and subsequently pulling the threads with the leasing comb through the treatment device, whereby the threads are transferred to the guide elements, wherein the leasing comb is pulled in steps through the device, the movement of the leasing comb is temporarily interrupted after passing the guide elements, and the leasing comb is positioned with respect to the guide element before the threads are transferred to the guide element, and comprising the further step of removing the guide elements out of a path formed for the threads in the treatment device, prior to leasing and moving back the guide elements after passing the leasing comb into the path of the threads, whereby the threads are taken up by the guide elements.

2. A method for leasing threads into guide elements of a treatment device for treating the threads, comprising the steps of leasing the threads into at least one leasing comb, fastening the threads onto said comb, and subsequently pulling the threads with the leasing comb through the treatment device, whereby the threads are transferred to the guide elements, wherein the leasing comb is pulled in steps through the device, the movement of the leasing comb is temporarily interrupted after passing the guide elements, and the leasing comb is positioned with respect to the guide element before the threads are transferred to the guide element, and said leasing comb has leasing interstices for receiving the threads, whose arrangement corresponds to an arrangement of interstices in the guide elements, and aligning projections which are in alignment with the leasing interstices, said method comprising the step of aligning the leasing comb to the guide elements such that the aligning projections of the leasing comb may be brought into engagement with the interstices of the guide elements.

3. A method according to claim 2, comprising the further step of pushing the interstices of the guide elements over the aligning projections when the guide elements are moved back into the path for the threads.

4. An auxiliary device for leasing threads into guide elements of a device for treating the threads, wherein the auxiliary device is formed as a leasing comb comprising an arrangement for the ordered fastening of the threads on the leasing comb and wherein the leasing comb has aligning elements for aligning the leasing comb onto the guide elements wherein the leasing comb is provided with a plurality of leasing interstices arranged next to one another, for receiving the threads and said aligning elements are designed as aligning projections which are aligned onto said leasing interstices, and which may be brought into engagement with interstices in the guide elements.

5. An auxiliary device according to claim 4, wherein the leasing comb is designed as a stack of platelets, wherein first platelets are arranged at a distance to one another thereby forming leasing interstices and wherein second platelets are arranged as distancers between said first platelets.

6. An auxiliary device according to claim 5, wherein said second platelets form a rest surface for threads in the leasing interstices.

7. An auxiliary device according to claim 5, wherein the second platelets have projections serving as aligning elements.

8. An auxiliary device according to claim 4, wherein the leasing comb has holding elements for the temporary receiving and holding of the leasing comb in receiving devices allocated to the guide elements.

9. A combination of a device for treating threads comprising at least one guide element through which the threads may be guided, and at least one leasing comb, one which the threads are fastenable in an ordered manner and from which the threads may be transferred by said guide elements, wherein the leasing comb has aligning elements for aligning the leasing comb on said at least one guide element, wherein said at least one guide element is moveable out of a path for the threads.

* * * * *